US005341951A

United States Patent [19]

Springston

[11] Patent Number: 5,341,951

[45] Date of Patent: Aug. 30, 1994

[54] AIR-FILTERING HYDRAULIC RESERVOIR BREATHER CAP

[75] Inventor: Eric Springston, Greene, N.Y.

[73] Assignee: The Raymond Corporation, Greene, N.Y.

[21] Appl. No.: 56,694

[22] Filed: Apr. 30, 1993

[51] Int. Cl.[5] ..... B65D 51/16

[52] U.S. Cl. ..... 220/371; 220/374

[58] Field of Search ..... 220/374, 373, 371, DIG. 33, 220/746, 747

[56] References Cited

U.S. PATENT DOCUMENTS

| | | | |
|---|---|---|---|
| 2,675,093 | 4/1954 | McCall et al. | 220/371 X |
| 2,836,258 | 5/1958 | Price | 220/371 X |
| 3,160,487 | 12/1964 | Risse et al. | 220/371 X |
| 3,255,743 | 6/1966 | Kolbe et al. | 220/371 X |
| 3,422,982 | 1/1969 | Terwoerds et al. | 220/374 X |
| 3,451,584 | 6/1969 | Degaetano | 220/371 |
| 3,961,724 | 6/1976 | Kapsy | 220/371 |
| 4,136,796 | 1/1979 | Dubois et al. | 220/371 X |
| 4,476,995 | 10/1984 | Bellino et al. | 220/371 |
| 4,512,499 | 4/1985 | Uuskallio | 220/374 |
| 4,595,118 | 6/1986 | Azuma et al. | 220/374 |
| 4,889,160 | 12/1989 | Sheets | 220/371 X |

*Primary Examiner*—Steven M. Pollard
*Attorney, Agent, or Firm*—Salzman & Levy

[57] ABSTRACT

The present invention features a breather cap for use in venting an oil reservoir. The cap vents high-velocity air flowing out of the oil reservoir, entraining the droplets of oil that are suspended in the escaping air. The breather cap is designed to slow the speed of the escaping air. This slowing mechanism is usually a large-volume chamber that is typically placed within the bottom of the cap. The air is directed against a deflector plate or a deflecting surface on top of the chamber. This deflected air deposits the tiny droplets upon the deflection surface. The separated oil is caused to pool or accumulate and drip back into the bottom of the chamber and then into the oil reservoir. The purified, lighter air thus rises above the deflector and is then vented through exit holes located in the top or side of the cap.

3 Claims, 4 Drawing Sheets

AIR-FILTERING HYDRAULIC RESERVOIR BREATHER CAP

FIELD OF THE INVENTION

The present invention pertains to an air-filtering hydraulic reservoir cap, and, more particularly, to a hydraulic reservoir breather cap that separates and isolates airborne oil from the air venting therefrom.

BACKGROUND OF THE INVENTION

Hydraulic reservoir breather caps are commonly employed to receive high-velocity air impregnated with suspended oil droplets from machinery. Such breather caps filter the air that is thus being expelled into the atmosphere.

A common problem in the current design of a hydraulic reservoir breather cap is its inability to adequately filter or separate the oil droplets suspended in the rapidly expelled air. Presently, oil droplets that are filtered from vented air tend to pool and drip from the undersides of the cap onto surrounding surfaces. Also, not all of the suspended, air-laden oil is separated from the air as it exits the cap. Such vented air is, therefore, a pollutant.

The present invention seeks to more adequately separate the suspended, airborne oil from the air exiting the hydraulic reservoir breather cap. The breather cap designs of the present invention slow the high-speed air within an internal chamber, causing the heavier oil droplets to impinge upon a deflector plate or a deflecting chamber surface. The deflector plate or deflecting surface prevents the high-speed air from directly venting to the atmosphere. The suspended oil impinging upon the plate or deflecting surface is then released from the slowed air, which is then allowed to vent from the breather cap. The separated oil droplets pool upon the deflector plate or deflecting surface and drop to the bottom of the breather cap chamber. From there, the oil drops back into the oil reservoir. Being substantially free of oil, the vented air is now lighter and rises above the deflector plate, where it exits the cap. Thus, this air is no longer considered a pollution problem.

DISCUSSION OF RELATED ART

In U.S. Pat. No. 3,160,487 (issued to Risse et al on Dec. 8, 1964, for a BREATHER CAP), a crankcase breather cap that fits over the oil-fill tube of a combustion engine is illustrated. The breather cap features filter material disposed about the cap and surrounding the oil-fill tube. The cap allows the crankcase to be pressurized with the flow of air at certain speeds.

In U.S. Pat. No. 3,255,743 (issued to Kolbe et al on Jun. 14, 1966, for a CRANKCASE VENTILATION ARRANGEMENT), a breather cap that fits over the oil-fill tube of an internal combustion engine is shown. The breather cap is designed with a one-way valve, which closes in response to exceedingly low crankcase pressures. Thus, the flow of crankcase vapors through the inlet into the atmosphere is thereby prevented. In this fashion, the breather cap stems pollution.

In U.S. Pat. No. 4,476,995 (issued to Bellino et al on Oct. 16, 1984, for BREATHER CAP), an internal combustion engine breather cap for use with fuel tanks is illustrated. The cap has a special twist-in feature and contains a foam filter element.

In U.S. Pat. No. 2,836,258 (issued to Price on May 27, 1958, for CAP FOR LIQUID RECEPTACLES), a crankcase cap is shown in which an internal spring allows the cap to snap onto the fill tube.

In U.S. Pat. No. 4,136,796 (issued to Dubois et al on Jan. 30, 1979, for VENTED CLOSURE), a breather cap is shown for a container. The cap has a membrane across its base that prevents the escape of any liquids in the container, but allows any gas under pressure therein to pass therethrough.

In U.S. Pat. No. 3,451,584 (issued to Degaetano on Jun. 24, 1969, for OIL FILLER BREATHER CAP), a breather cap is depicted with an inexpensive filter, designed to be replaceable.

SUMMARY OF THE INVENTION

In accordance with the present invention, there is provided a breather cap for use in venting an oil reservoir. The cap vents high-velocity air flowing out of the oil reservoir, entraining the droplets of oil that are suspended in the escaping air. The breather cap is designed with a means to slow the speed of the escaping air. This slowing mechanism is usually a large-volume chamber that is typically found within the bottom of the cap. The air is directed against a deflector plate or a deflecting surface on top of the chamber. This deflected air deposits the tiny droplets upon the deflection surface. The separated oil is caused to pool or accumulate and drip back into the bottom of the chamber and then into the oil reservoir. The purified, lighter air thus rises above the deflector and is then vented through exit holes disposed in the top or side of the cap.

It is an object of this invention to provide an improved breather cap for an oil reservoir.

It is another object of the invention to provide a breather cap for an oil reservoir, with a cap that will remove the suspended oil droplets from high-velocity air and expel the then purified air from the breather cap with no oil leakage.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a breather cap for an oil reservoir, a cap that receives high-velocity air laden with suspended oil droplets. The breather cap's purpose is to filter the oil from the air and return same back into the oil reservoir. Thus, only the purified air is allowed to pass out of the breather cap into the environment.

For purposes of brevity and clarity, like elements and components will bear the same designation throughout the FIGURES.

Figure 1A:
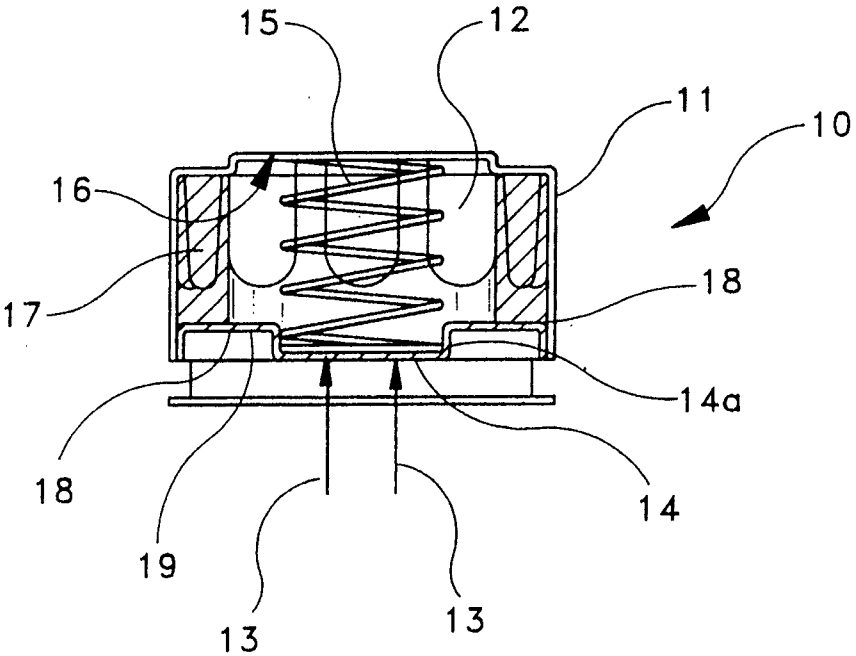
FIG-1a PRIOR ART
FIG. 1*a* illustrates a sectional view of a prior art breather cap that leaked oil.

Now referring to FIG. 1*a*, a prior art breather cap for filtering oil from air exiting an oil reservoir is shown by arrow 10. The breather cap is comprised of an outer cap housing 11 encasing an inner chamber 12. The chamber 12 receives (arrows 13) high-velocity, oil-laden air through inlet 14 that fits over the oil-fill tube (not shown). A coil spring 15 is positioned between the inner, upper surface 16 of the housing 11 and the inlet bore 14*a*. The coil spring 15 provides compressive force that maintains a snug fit about the fill tube. An oil filter 17 comprising an annular ring of porous material, such as steel wool, is positioned about the inner periphery of chamber 12. The air entering the chamber 12 is deflected by the inner surface 16 of the housing 11; it passes through filter 17 and exits through vent holes 18 in bottom plate 19.

Unfortunately, due to its high rate of speed, this air that is laden with fine droplets of suspended oil escapes the chamber 12 without sufficiently yielding its oil to the filter 17. Some of the suspended oil remains suspended; some is vented to the air. In addition, being positioned over the vent holes 18, the filter 17 allows part of the entrapped oil to drip from the vent holes 18 onto surrounding surfaces, as shown.

Figure 1:
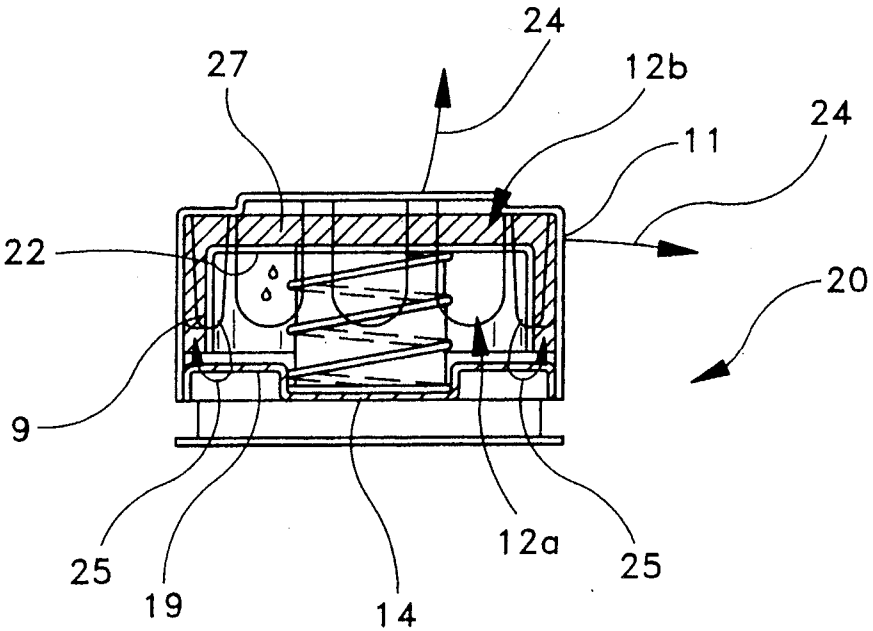
FIG. 1 shows a sectional view of a preferred embodiment of the breather cap of this invention.
Figure 1B:
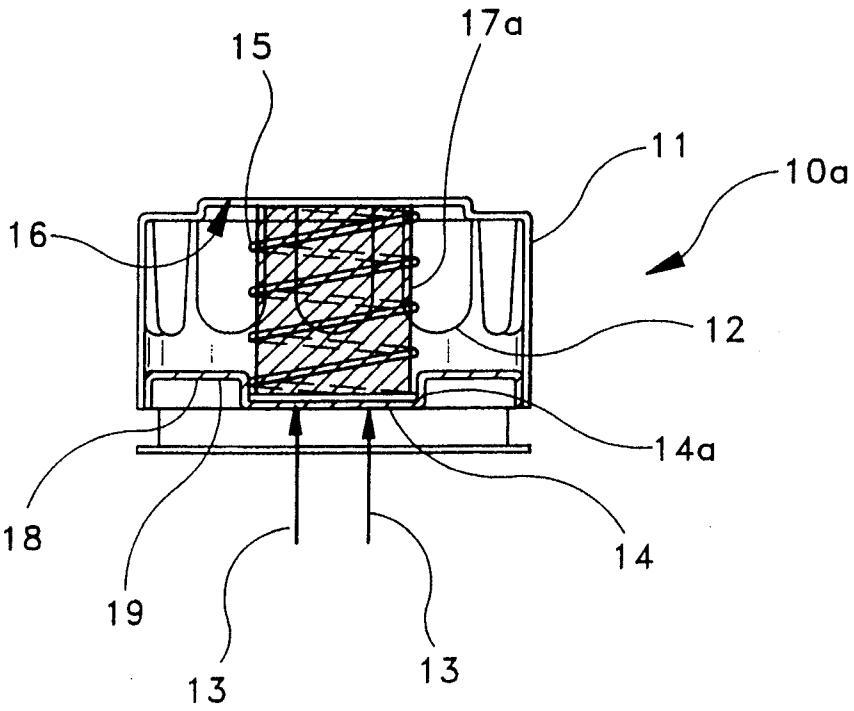
FIG-1b PRIOR ART
FIG. 1*b* depicts a sectional view of a modified breather cap shown in FIG. 1*a* that still continued to leak oil.

Referring to FIG. 1*b*, a modified breather cap 10*a* of the breather cap 10 shown in FIG. 1*a* is illustrated. The modified breather cap 10*a* has its filter 17*a* disposed as a central core, cylindrical member within coil spring 15; filter 17*a* is positioned directly over the inlet 14.

It was originally thought that, being positioned over the inlet, filter 17*a* would allow the oil to drip back into the reservoir (not shown) and solve the leakage problem that was experienced with the design illustrated in FIG. 1*a*. However, the high-speed air did not efficiently yield its oil to the filter 17*a*; the leakage problem persisted.

Now referring to FIG. 1, a preferred embodiment of the breather cap 20 of this invention is shown. This breather cap 20 is designed with two separate (lower and upper) chambers 12*a* and 12*b*, respectively. Lower chamber 12*a* provides a means by which the high-velocity air can be slowed down. The lower chamber 12*a* is defined by a deflector plate 9 that is shaped like an inverted cup. The deflector plate receives the direct impact of the air entering the inlet 14. Being caused to slow, the air yields its oil, depositing upon the upper, inner surface 22 of the inverted cup 9. The tiny droplets of oil aggregate upon this surface 22 and eventually drip into the lower housing plate 19 and back into the oil reservoir. The slowed air then necks around the inverted cup 9, as shown by arrows 25, and enters upper chamber 12*b*. Having yielded its oil, the slowed air is lighter. It thus rises into upper chamber 12*b*. There the air is filtered by filter 27 to remove any remaining oil. The purified air is then vented through holes in the sides or top of the housing 11, as illustrated by arrows 24.

Figure 2:
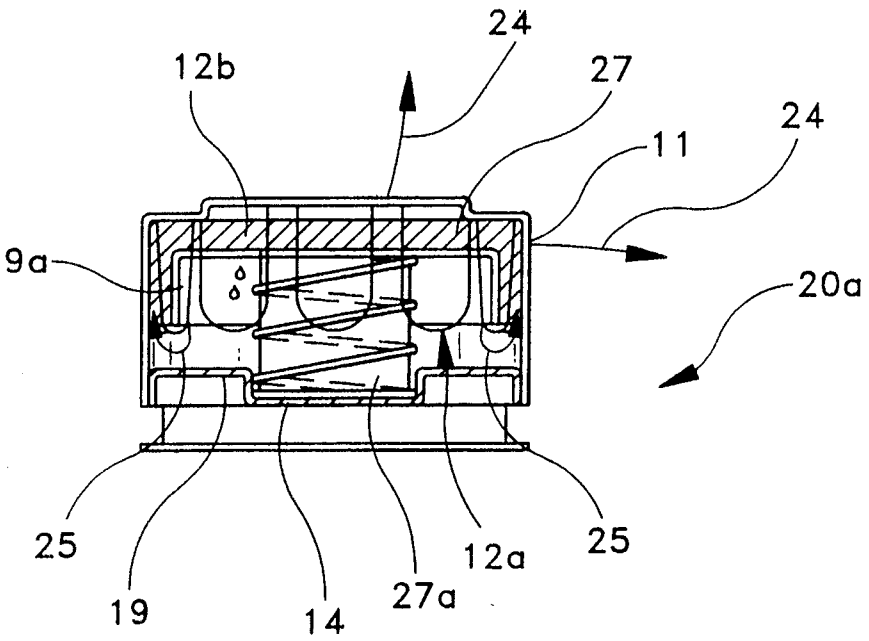
FIG. 2 illustrates a sectional view of a slightly modified alternate embodiment of the breather cap shown in FIG. 1.

Referring to FIG. 2, a modified embodiment breather cap 20*a* of the breather cap 20 shown in FIG. 1 is provided, having a central core, cylindrical filter 27*a* in lower chamber 12*a*. The added filter 27*a* provides for additional separation and isolation of the oil from the high-speed air. The inverted cup 9*a* is designed slightly smaller than that of FIG. 1, thus allowing the air to move more freely to the upper chamber 12*b*.

Figure 3:
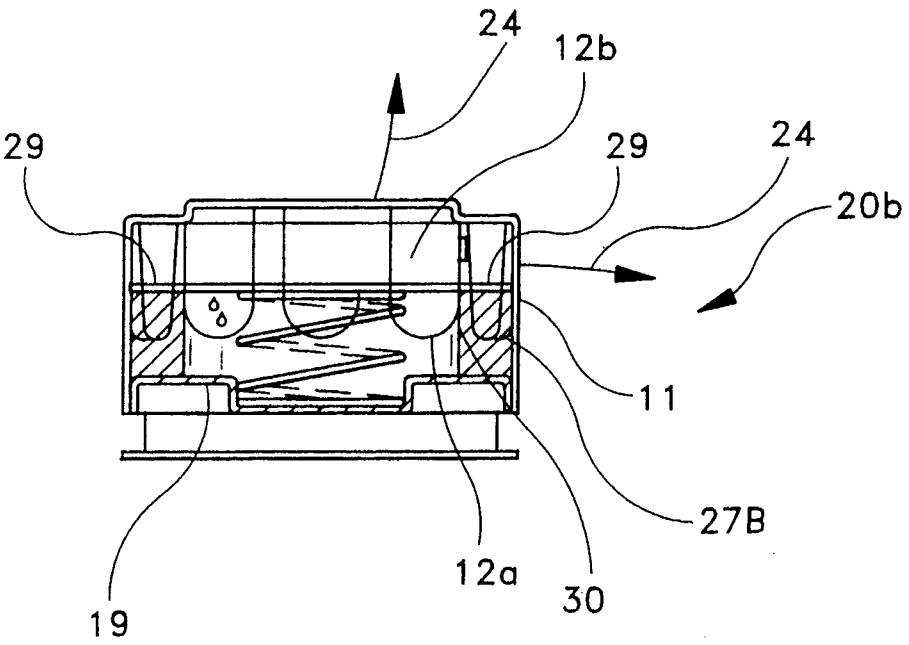
FIG. 3 depicts a sectional view of a third embodiment of the breather cap of the invention, shown in FIG. 1.

Referring to FIG. 3, a third embodiment of the invention is illustrated. The new breather cap 20*b* features a flat, air deflection plate 30, which divides the breather cap into a low-velocity reduction chamber 12*a* and an upper venting chamber 12*b*. The oil filter 27*b* now takes the form of an annular cylinder disposed at the outer periphery of housing 11. The deflection plate 30 slows the high-speed air, which then yields its oil, as in the prior embodiments. Holes 29, disposed in the divider plate 30 directly above the filter 27*b*, allow the slowed air to enter the upper venting chamber 12*b* and exit (arrows 24) from the housing as previously shown.

Figure 4:
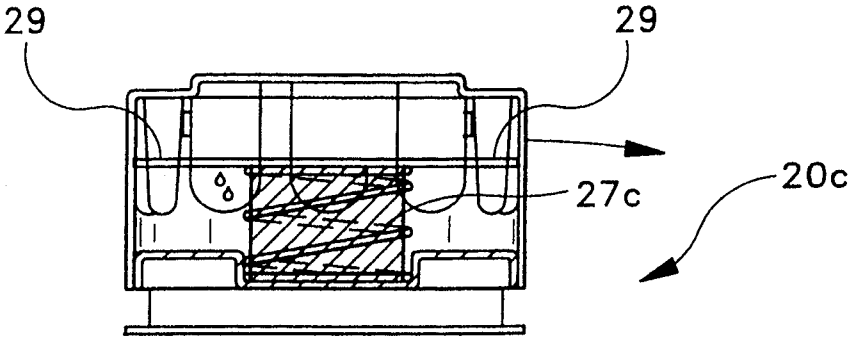
FIG. 4 shows a sectional view of a modified breather cap embodiment as depicted in FIG. 3.

Referring to FIG. 4, an alternate embodiment is shown with respect to the breather cap 20*b* depicted in FIG. 3. The alternate embodiment is illustrated as breather cap 20*c*. The oil filter 27*c* is designed as a central core, cylinder member. In all other respects, this embodiment acts in like manner as that embodiment shown in FIG. 3.

Figure 5:
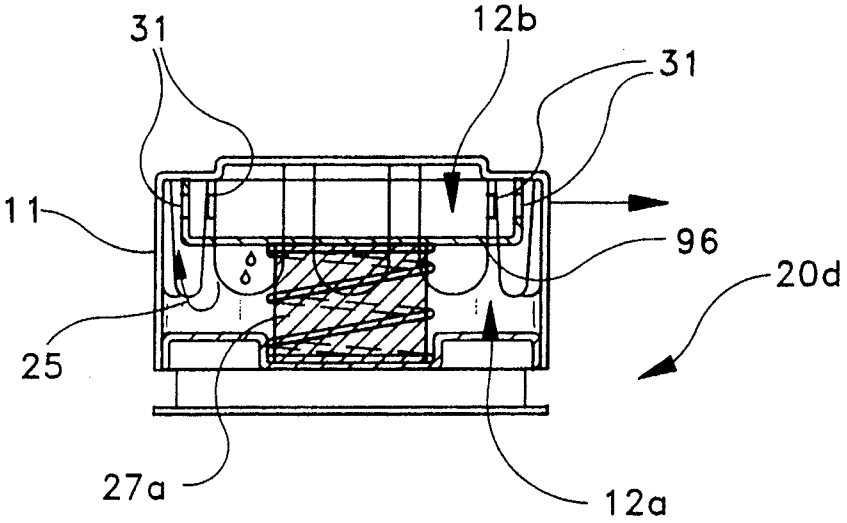
FIG. 5 illustrates a sectional view of a fifth embodiment of the breather cap shown in FIG. 1.

Referring to FIG. 5, a fifth embodiment is depicted. This embodiment illustrates a modification to the embodiment shown in FIG. 2. The fifth embodiment, shown as breather cap 20*d*, depicts an upright chamber cup 9*b*. Slowed air rising (arrow 25) from chamber 12*a* into the cavity formed between the cup 9*b* and the housing 11 enters the upper venting chamber 12*b* through perforation holes 31 disposed in the upper portion of upright chamber cup 9*b*.

Figure 6:
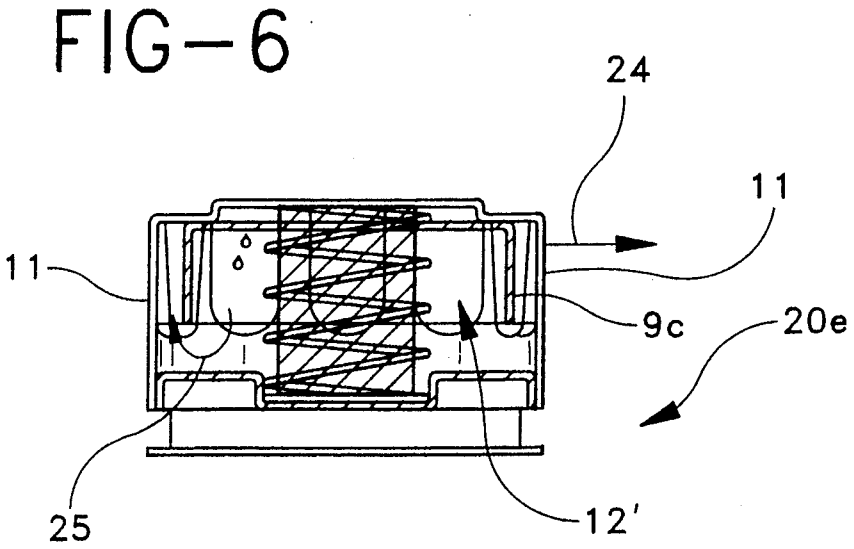
FIG. 6 depicts a sectional view of a modified embodiment of the breather cap as illustrated in FIG. 5.

Referring to FIG. 6, a sixth embodiment is shown, in which the breather cap 20*e* as but one chamber 12', defined by inverted cup deflector plate 9*c*. Slowed air rising (arrow 25) from chamber 12' into the cavity formed between the cup 9*b* and the housing exits from the side of the housing (arrow 24).

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A breather cap for an oil reservoir, said breather cap being positioned over an oil reservoir outlet having the shape of a cylindrical bore, said breather cap receiving high-velocity air containing suspended droplets of oil, said breather cap separating the oil from said air, which is then vented to the atmosphere, said breather cap comprising:

a housing defining an outer shell of said breather cap, said housing being separated into two portions, comprising an upper portion and a lower portion;

cylindrical attachment means disposed within a central portion of said housing for affixing said breather cap to said oil reservoir outlet, said cylindrical attachment means comprising a cylindrical coil spring for providing a compressive biasing between said outlet and said housing for maintaining a snug fit therebetween;

an inverted, cup-shaped deflection means having a substantially flat, disc-like mid-section disposed within a mid-portion of said housing over said oil reservoir outlet, said inverted, cup-shaped deflection means delineating said upper portion of said breather cap from said lower portion, said inverted, cup-shaped deflection means for receiving and slowing said high-velocity air containing said suspended droplets of oil, said high-velocity air impinging upon said substantially flat, disc-like mid-section and being caused to slow its velocity, thereby causing said suspended droplets of oil to separate therefrom, deposit, and aggregate upon said substantially flat, disc-like section, said oil droplets thereafter dripping back into said oil reservoir, and the substantially oil-free air then flowing to a periphery of said substantially flat, disc-like section, and thereafter rising upwards into said upper portion of said housing;

means defining a narrow, annular passage disposed between said housing and said inverted, cup-shaped deflection means, wherein said substantially oil-free air is caused to rise upwards into said upper portion of said housing after twice changing flow direction;

filtering means disposed within said cylindrical attachment means for assisting in the separation of said suspended droplets of oil from said high-velocity air prior to the impinging thereof upon said substantially flat, disc-like mid-section; and venting means supported in said upper portion of said housing for allowing said substantially oil-free air to flow out of and vent from said housing.

2. A breather cap for an oil reservoir, said breather cap being positioned over an oil reservoir outlet having the shape of a cylindrical bore, said breather cap receiving high-velocity air containing suspended droplets of oil, said breather cap separating the oil from said air, which is then vented to the atmosphere, said breather cap comprising:

a housing defining an outer shell of said breather cap, said housing being separated into two portions, comprising an upper portion and a lower portion;

cylindrical attachment means disposed within a central portion of said housing for affixing said breather cap to said oil reservoir outlet, said cylindrical attachment means comprising a cylindrical coil spring for providing a compressive biasing between said outlet and said housing for maintaining a snug fit therebetween;

an upright, cup-shaped deflection means having a substantially flat, disc-like mid-section disposed within a mid-portion of said housing over said oil reservoir outlet, said upright, cup-shaped deflection means delineating said upper portion of said breather cap from said lower portion, said upright, cup-shaped deflection means for receiving and slowing said high-velocity air containing said suspended droplets of oil, said high-velocity air impinging upon said substantially flat, disc-like mid-section and being caused to slow its velocity, thereby causing said suspended droplets of oil to separate therefrom, deposit, and aggregate upon said substantially flat, disc-like section, said oil droplets thereafter dripping back into said oil reservoir, and the substantially oil-free air then flowing to a periphery of said substantially flat, disc-like section, and thereafter rising upwards into said upper portion of said housing;

means defining a narrow, annular passage disposed between said housing and said upright, cup-shaped deflection means, wherein said substantially oil-free air is caused to rise upwards into said upper portion of said housing;

filtering means disposed within said cylindrical attachment means for assisting in the separation of said suspended droplets of oil from said high-velocity air prior to the impinging thereof upon said substantially flat, disc-like mid-section; and venting means supported in said upper portion of said housing for allowing said substantially oil-free air to flow out of and vent from said housing.

3. A breather cap for an oil reservoir, said breather cap being positioned over an oil reservoir outlet having the shape of a cylindrical bore, said breather cap receiving high-velocity air containing suspended droplets of oil, said breather cap separating the oil from said air, which is then vented to the atmosphere, said breather cap comprising:

a housing defining an outer shell of said breather cap, said housing being separated into two portions, comprising an upper portion and a lower portion;

cylindrical attachment means disposed within a central portion of said housing for affixing said breather cap to said oil reservoir outlet, said cylindrical attachment means comprising a cylindrical coil spring for providing a compressive biasing between said outlet and said housing for maintaining a snug fit therebetween;

a cup-shaped deflection means having a substantially flat, disc-like mid-section disposed within a mid-portion of said housing over said oil reservoir outlet, said cup-shaped deflection means delineating said upper portion of said breather cap from said lower portion, said cup-shaped deflection means for receiving and slowing said high-velocity air containing said suspended droplets of oil, said high-velocity air impinging upon said substantially flat, disc-like mid-section and being caused to slow its velocity, thereby causing said suspended droplets of oil to separate therefrom, deposit, and aggregate upon said substantially flat, disc-like section, said oil droplets thereafter dripping back into said oil reservoir, and the substantially oil-free air then flowing to a periphery of said substantially flat, disc-like section, and thereafter rising upwards into said upper portion of said housing;

means defining a narrow, annular passage disposed between said housing and said cup-shaped deflection means, wherein said substantially oil-free air is caused to rise upwards into said upper portion of said housing;

filtering means disposed within said cup-shaped deflection means and said housing for assisting in the separation of said suspended droplets of oil from said high-velocity air after said impinging thereof upon said substantially flat, disc-like mid-section; and venting means supported in said upper portion of said housing for allowing said substantially oil-free air to flow out of and vent from said housing.

* * * * *